United States Patent [19]

Smith

[11] 4,443,009

[45] Apr. 17, 1984

[54] POLE VAULTER'S LANDING CUSHION

[75] Inventor: Stephen N. Smith, Leucadia, Calif.

[73] Assignee: Ampro Corporation, Anaheim, Calif.

[21] Appl. No.: 308,594

[22] Filed: Oct. 5, 1981

[51] Int. Cl.[3] ..... A63B 5/00

[52] U.S. Cl. ..... 272/104; 272/101

[58] Field of Search ..... 272/101, 104; 5/420, 5/448

[56] References Cited

U.S. PATENT DOCUMENTS

| | | | |
|---|---|---|---|
| 1,673,636 | 6/1928 | Perry . | |
| 3,391,414 | 7/1968 | Gordon | 5/348 |
| 3,399,407 | 9/1968 | Olson | 5/348 |
| 3,965,507 | 6/1976 | Reiland | 272/104 |
| 4,057,245 | 11/1977 | Gordon | 272/101 |
| 4,215,857 | 8/1980 | Gordon | 272/101 |
| 4,245,838 | 1/1981 | Gordon | 272/101 |

OTHER PUBLICATIONS

Two Pages of Sketches, Labelled "R-2 Pit", Prepared in 1974 at Facilitites of Assignee of Present Application.

*Primary Examiner*—Richard J. Apley
*Assistant Examiner*—S. R. Crow
*Attorney, Agent, or Firm*—Phillips, Moore, Lempio & Finley

[57] ABSTRACT

A notch or cutout configuration for a pole vaulter's landing cushion provides increased protection for the athlete while avoiding interference with bending of the vaulting pole. The top of the notch is broad at the pole planting region and relatively narrow at a more forward region. In the preferred form, the base of the notch is narrow in the pole planting region and broadens towards the front of the cushion to conform with the outline of a vaulting box, the sidewalls and back wall of the notch being inclined outwardly in the pole planting region while the notch sidewalls in the more forward region are vertical. In addition to providing more extensive cushioning adjacent the vaulting box area, the configuration enhances performance by reducing the athlete's concerns about contact of the pole with the cushion and about landing. The configuration requires correct placement of the landing cushion relative to the vaulting box in order to avoid pole contact with the cushion and thus discourages the common practice of intentional mispositioning of a cushion for such purpose.

12 Claims, 4 Drawing Figures

POLE VAULTER'S LANDING CUSHION

TECHNICAL FIELD

This invention relates to athletic equipment and more particularly to landing cushions which have a notch or cutout in the forward end for receiving the base of a vaulting pole.

BACKGROUND OF THE INVENTION

In the course of pole vaulting the end of the vaulting pole is engaged in a vaulting or planting box at ground level that serves as a pivot point for the pole. It is a practical necessity that some form of padding be provided behind the vaulting box and preferably at each side of the box as well in order to cushion the descent of the athlete at the conclusion of a vault. In addition to providing protection, such padding also enhances performance by reducing the athlete's concern about landing.

Padding is typically provided for by utilizing an extensive landing cushion formed of a resilient material such as urethane foam or any of various other synthetic foam substances which exhibit similar physical properties. To pad areas at each side of the vaulting box while enabling planting of the pole, such landing cushions have a rearwardly extending notch in the front end in position to be situated over the vaulting box when the cushion is in use.

Early pole vaulting installations sometimes provided for cushioning of the athlete's descent by means of an excavation behind the vaulting box which was filled with sawdust or the like and out of custom it is common to refer to the more recently developed landing cushions of the above discussed kind as landing "pits". Also as a matter of custom the notch is often referred to by the term "cutout" since in some cases it is formed by cutting away material from the front portion of a cushion. Use of these customary terms herein should not be construed to mean that the cushion necessarily extend below ground level in use nor that the notch necessarily be manufactured by removing material from the front of a cushion assembly. More typically, under current practice, the landing cushion is situated wholly above ground and may be manufactured by assembling precut blocks of resilient foam material.

The configuration of the notch or cutout has been a source of serious problems because of seemingly conflicting requirements which should be met. As the area of impact of the athlete is variable and unpredictable, particularly in the case of unsuccessful vaults, it is desirable that the cushion extend as closely as is practical to both the back and the sides of the vaulting box. An opposing consideration has been that if a notch or cutout of conventional shape is sufficiently constricted to best serve that objective, then it may also interfere with bending of the vaulting pole.

During the initial stages of a vault, the pole typically undergoes a very pronounced bending. While the bending of the pole at a very early stage of the vault tends to be directed towards the back of the notch, this condition does not persist. At a later stage, when the curvature has become more pronounced and the athlete is rising, the bowing of the pole tends to shift and become more sidewardly directed. If the bent pole contacts the notch sidewalls or other surfaces at that stage a poor vault or a failed vault is likely to result. Even in instances where contact of the pole with the walls of the notch does not actually occur, the knowledge that it is possible may inhibit the athlete's maneuvers.

The size of the conventional rectangular notch or cutout relative to the vaulting box has tended to be a compromise between these opposing considerations and has not been fully satisfactory from either standpoint.

Efforts have heretofore been made to design a specialized notch configuration which would provide more extensive protection in the vaulting box area while also allowing for bending of the pole. In particular, landing cushions have been provided with a notch having sidewalls which converge towards the back of the notch while being divergent from each other in the upward direction so that the notch is broader at the top than at the bottom and broader at the front than at the back.

These prior specialized notch configurations have by no means fully resolved the conflict between the objective of providing increased protection for the athlete and that of avoiding interference with the vaulting pole. If the width of the notch and the slant of the sidewalls are sufficiently small to provide the preferred degree of protection then contacts of the curved pole with the sides of the notch and restriction or inhibition of the athlete's motions remain common occurrences. The problem has been aggravated by the increasing use of extremely flexible poles, having resiliencies matched to the weight and strength of the vaulter, in order to vault to greater heights. Utilizing this modern equipment and techniques, pole curvatures tend to be much more extreme than in the past.

Prior cushions having these specialized notch configurations typically have a top surface which slopes downward toward the front of the cushion. An undesirable result of the problem discussed above has been a tendency for athletes to try and avoid the pole contact problem by placing the landing cushion further back, relative to the vaulting box, then was intended during the design of the cushion. This locates the vaulting box at a lower more forward region of the cushion and thus provides somewhat more pole maneuvering room. Unfortunately it also lessens the degree of protection provided to the athlete by the landing cushion. Rules prohibiting this practice have been made by organizations which sponsor track meets but it has been observed that such rules are often not enforced by officials who recognize the limitations on vaulting performance which may arise from actual contact of the pole with the walls of the notch or merely from inhibition brought about by the athlete's awareness of the possibility that a vault might be ruined by such an occurrence.

To resolve the above discussed problems, a landing cushion should provide cushioning material which extends closer to the sides of the vaulting box but in a configuration which enables freedom for bending of the base of the vaulting pole without contact between the pole and the walls of the notch. The configuration should not constitute an inducement for misplacement of the cushion relative to the vaulting box but should instead encourage a correct placement.

The present invention is directed to overcoming one or more of the problems set forth above.

SUMMARY OF THE INVENTION

In one aspect of the present invention, a pole vaulter's landing cushion has a front end with a rearwardly extending notch for receiving the base of a vaulting pole, the notch having sidewalls defining a pole planting region at the back end of the notch and defining a more forward region between the pole planting region and the front end of the cushion. The top of the notch is sufficiently broad at the pole planting region to accommodate a predetermined amount of bending of the pole towards the sides of the notch while being sufficiently narrower at the forward region to inhibit the predetermined amount of bending of the pole towards the sides of the notch. The sidewalls are stepped at the location where the pole planting region connects with the forward region to provide an abrupt change in the width of the top of the notch at that location, the top of the notch being substantially broader at the pole planting region than at the forward region.

In another aspect of the invention, the notch is narrower at the base of the pole planting region than at the top of the pole planting region, the notch sidewalls at the pole planting region being slanted upwardly and outwardly from the base to the top of the pole planting region, the sidewalls having a more vertical orientation at the forward region of the notch.

In another aspect of the invention, the cushion is of substantially uniform height from the front end back to the pole planting region, the uniform height being less than the height of the portion of the cushion which is behind the pole planting region.

In still another aspect of the invention, the base of the notch substantially conforms in outline with the outline of the pole planting recess of a vaulting box.

In still another specific aspect of the invention, the top of the notch has a substantially T-shaped outline.

In still another aspect of the invention, a pole vaulter's landing cushion includes a volume of resilient material having an end surface and a notch which extends inwardly from the end surface. A first region of the notch that is spaced inwardly from the end surface has a width sufficient to accommodate a predetermined amount of sideward bending of a vaulting pole. A second region of the notch that is closer to the end surface has a smaller width that is insufficient to accommodate to the predetermined amount of bending of the vaulting pole.

As a landing cushion in accordance with aspects of the present invention has a noch or cutout which is substantially broader at the top in the pole planting region than at a more forward part of the notch, problems arising from contact of the vaulting pole with the walls of the notch are avoided while more extensive cushioning is provided at the areas adjacent the vaulting box. In the preferred forms of the invention and in contrast to the prior art, cushioning material may extend to the vaulting box itself without impairing the vaulter's performance. The invention enhances performance by reducing the athlete's concerns about possible contact of the pole with the landing cushion during the early stages of a vault and about landing during a later stage. In the preferred forms, the invention effectively mandates a correct placement of the landing cushion relative to the vaulting box. Pole contact problems are not reduced by displacing the landing cushion backwardly from the designed position relative to the vaulting box, as is the case with prior art cushions of the kind discussed above. Rather, the risk of pole contact is increased by such misplacement owing to the substantial narrowing of the top of the notch of the present invention at a location forward from the pole planting region of the notch.

The invention together with additional objects and advantages thereof may be further understood by reference to the accompanying drawings and the following description of a detailed example.

DETAILED DESCRIPTION OF A PREFERRED EMBODIMENT OF THE INVENTION

Figure 1:
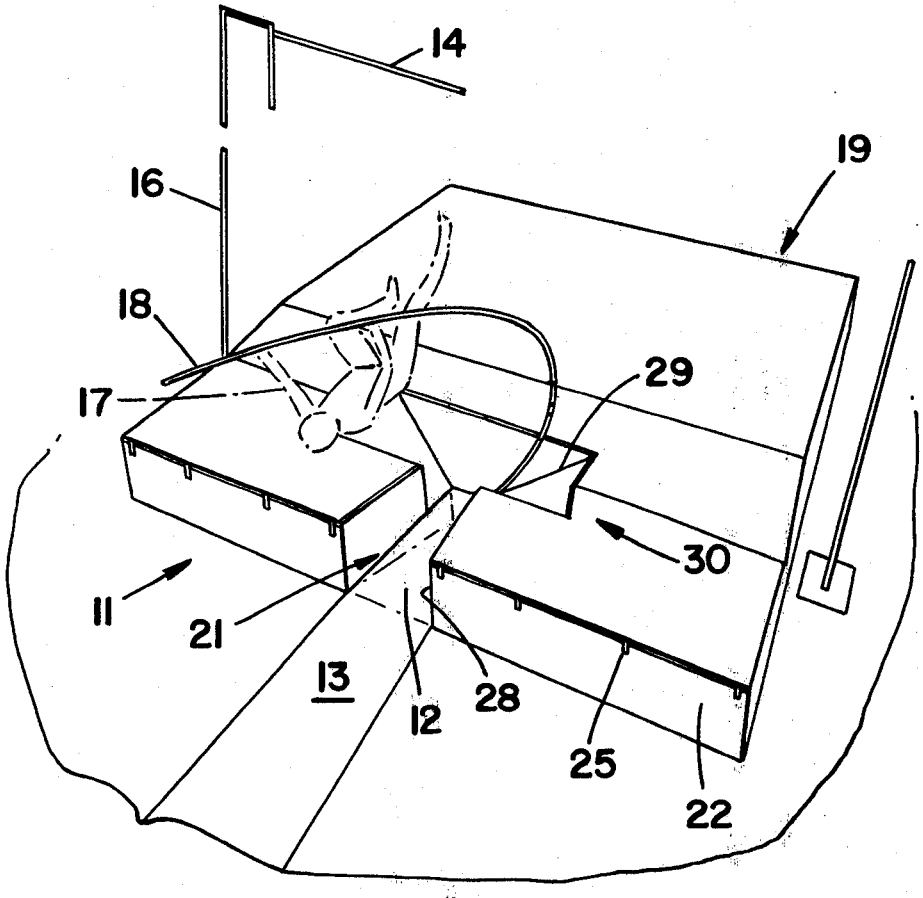
FIG. 1 is a perspective view of a pole vaulter's landing cushion in accordance with one embodiment of the invention, the landing cushion being shown in use at a vaulting installation.

Referring initially to FIG. 1, a pole vaulting installation 11 at an athletic field includes a vaulting box or planting box 12 fixed in the ground or other surface at the end of a vaulter's runway 13. A transverse crossbar 14 is supported by upright standards 16 at each side of the installation, the standards being extensible to provide for adjustment of the height of the crossbar. FIG. 1, which was prepared in conformity with a photograph of an embodiment of the invention in use, illustrates one of the positions which the vaulter's body 17 can assume at certain stages of a vault and which, along with the heights which are typically attempted, dictate that some form of resilient padding or protection be provided for cushioning the athlete's descent both in connection with successful and failed vaults. Under current practice, the cushioning is provided for by a landing cushion or pit 19 formed of fabric encased resilient sponge rubber like material, typically of one of the synthetic forms.

The general configuration and dimensions of a landing cushion 19 are to some extent prescribed and standardized by the various organizations which sponsor track and field meets and in general it is required that certain areas at each side of the vaulting box 12 be covered with cushioning material as well as the area behind the vaulting box where the vaulter 17 normally lands. This in turn requires that the cushion 19 have a notch 21 or cutout as it is sometimes termed which extends rearwardly a distance from the front end surface 22 of the cushion. In use, the landing cushion is positioned to locate the notch 21 over the vaulting box 12.

Figure 2:
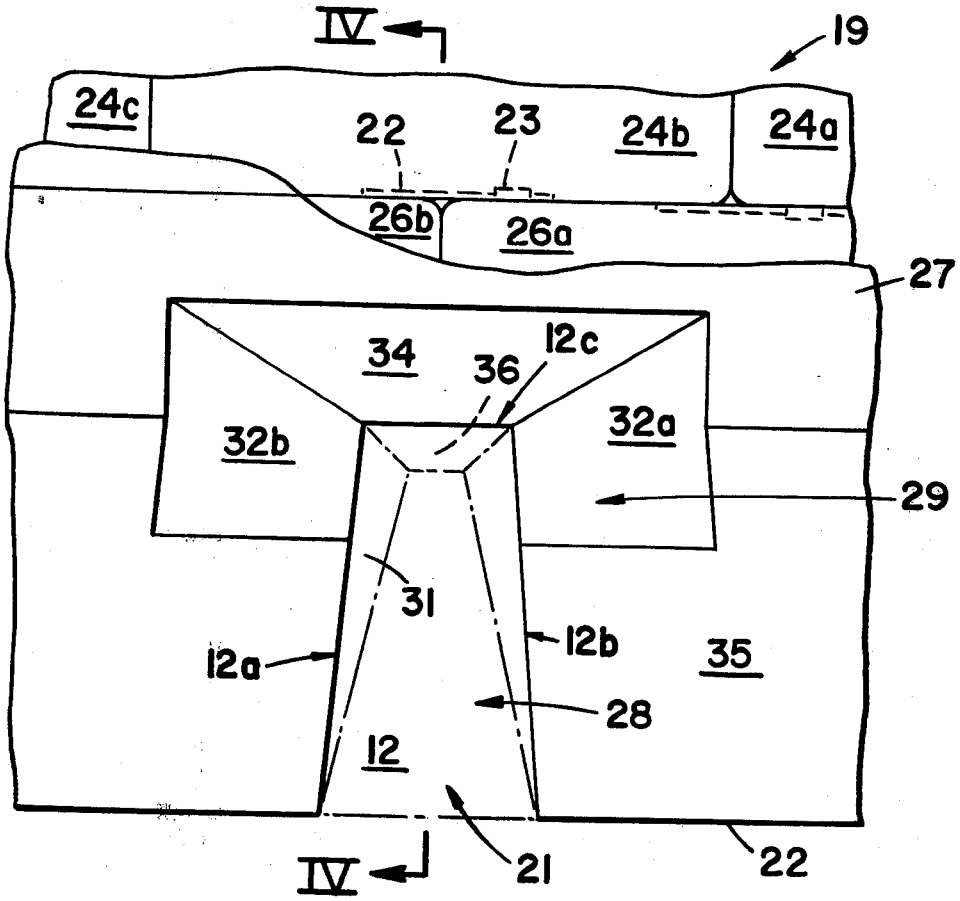
FIG. 2 is an enlarged plan view of the notch or cutout region of the landing cushion of FIG. 1.

While the landing cushion 19 can be constructed to be a single integral unit, this is not the more common construction as the resulting bulk and weight make it difficult to transport and store the cushion. More commonly, the cushion is an assembly of separable units which are temporarily held together during use by suitable means such as disengageable straps 22 and buckles 23 as shown in FIG. 2. In this particular example the rearward portion of the landing cushion is formed of three separable rectangular base units **24*a*, 24*b* and 24*c* disposed in side by side relationship. Two separable front units 26*a* and 26*b* are also disposed in side by side relationship in front of the rear units 24 with the junction of the two front units 26*a* and 26*b* being at the central plane of the vaulting box 12 in this example. The several component units 24*a*, 24*b*, 24*c*, 26*a* and 26*b*** are jointly covered, when in use, by a padded fabric cover 27 which is attached to such units by disengagable fasteners 25 and which defines the top surface of the landing cushion 19. It should be understood that the invention is equally applicable to landing cushions having other numbers and arrangements of component units or which are formed to be a permanent integral assembly.

Referring again to FIG. 1, the advantages of the present invention are realized by certain characteristics of the configuration of the notch 21 and adjacent portions of the cushion. The notch 21 has a forward region 28 closest to the front end 22 of the landing cushion and a more rearwardly located pole planting region 29. The opposite sidewalls 32*a* and 32*b* of the notch 21 are stepped at the location 30 where the pole planting region 29 connects with the forward region 28 to provide an abrupt change of the width of the top portion of notch 21 at that location, the top of the pole planting region 29 of the notch being substantially broader than the forward region 28 of the notch.

Figure 3:
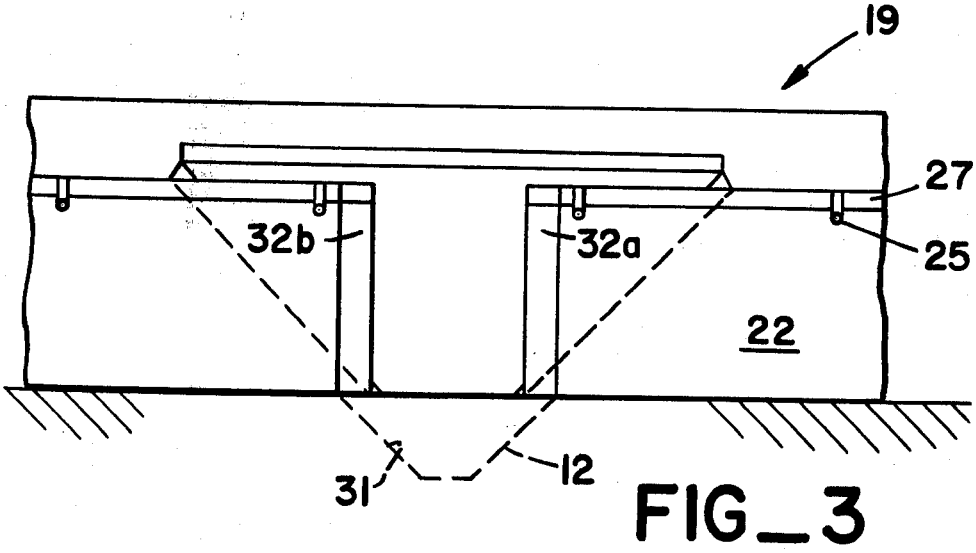
FIG. 3 is a front elevation view of the portion of the landing cushion depicted in FIG. 2.

Referring now to FIGS. 2 and 3 in conjunction, the bottom or base portion of the notch 21 in the preferred embodiment has a different configuration from the top in order to situate cushioning material closely adjacent both sides 12*a* and 12*b* and the back 12*c* of vaulting box 12. The standardized vaulting box 12 has a recess 31 extending below ground level which slopes downwardly towards the back and which also becomes narrower towards the back. Recess 31 in effect forms a socket in which the end of the vaulting pole is placed in the course of vaulting. In the preferred form of the invention, the bottom of the notch 21 conforms in size and shape with the ground surface level outline of the vaulting box recess 31.

The sidewalls 32*a* and 32*b* of the notch 21 in the pole planting region 29 are inclined and slant upwardly and outwardly from the base to the top of the notch the inclination being about 45° in this particular example. At the forward region 28 of the notch 21, the sidewalls 32*a* and 32*b* extend more directly upwardly from the bottom of the notch 21 to maximize the amount of cushioning material at the sides of the vaulting box, and are preferably vertical as in this embodiment.

For similar reasons, the sidewalls 32*a* and 32*b* are divergent in the forward region 28 of notch 21, in conformity with the sides of vaulting box recess 31. The top surface 35 of the cushion at each side of the forward region 28 of the notch 21 is preferably horizontal. Thus the notch sidewalls 32*a* and 32*b* are of uniform height in the forward region 28. Top surface 35 slopes upwardly at the back of pole planting region 29 and is then again horizontal, at a higher elevation, at the rearmost portion of the cushion 19.

Figure 4:
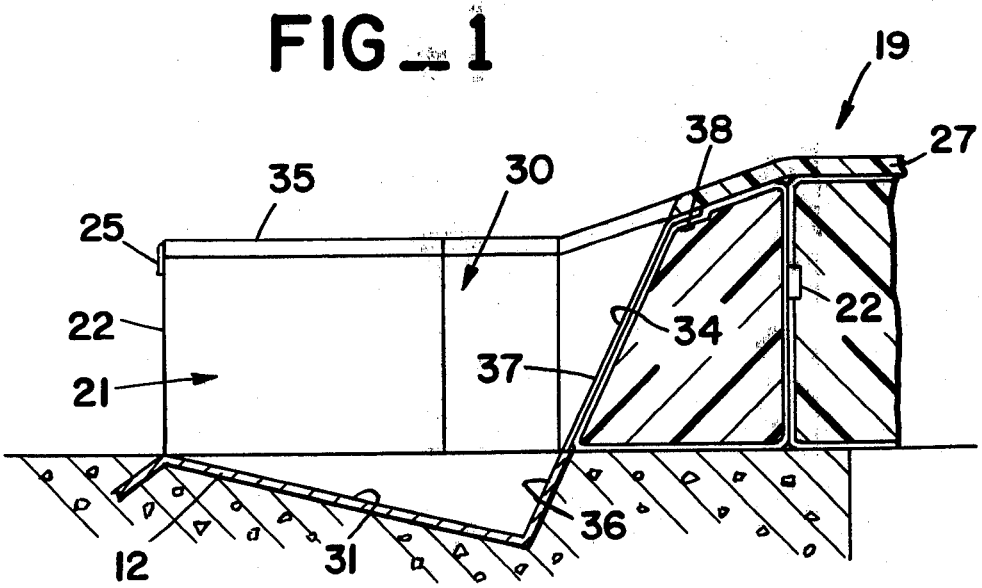
FIG. 4 is a vertical section view taken along line IV—IV of FIG. 2 and further illustrating the configuration of the notch or cutout of the landing cushion thereof.

The back wall 34 of the notch 21 at pole planting region 29 slants upward and backward from the back of the vaulting box 12, the slope of the back wall preferably being greater than that of the sidewalls 32*a* and 32*b* at the pole planting region. The back wall 34 may be more steeply inclined, to maximize the amount of cushioning material in the vicinity of the vaulting box 12 without causing pole contact problems, since the plane of curvature of the vaulting pole tends to flip into a transverse orientation relative to notch 21 at the stage of a vault where the curvature of the pole is greatest. As depicted in FIG. 4, the back wall 34 of the notch 21 may, for example, have the same inclination as the rear wall 36 of the planting box recess 31.

To protect the surfaces of the two front units 26*a* and 26*b* of the cushion 19 that would otherwise be exposed in the planting region 29 of the notch, the pole planting region is lined with a fabric skirt 37 which, as best seen in FIG. 4, may be attached around the upper edges to the cushion units 26*a*, 26*b* and 24*b* by disengageable fasteners such as snaps 38.

Thus in the depicted preferred embodiment of the invention, the top of the notch 21 as a whole has a substantially T-shaped configuration while the bottom of the notch has a shorter and narrower truncated V-shaped configuration. The sidewalls 32*a*, 32*b* and back wall 34 of the notch slope outwardly towards the top in the pole planting region 29, the sidewalls being vertical and also being divergent towards the front end 22 of the cushion 19 in forward region 28. This preferred configuration maximizes the extent of padding in the regions behind and at each side of the vaulting box 12 without interfering with bending of the vaulting pole during the initial stages of the vault. The walls 32*a*, 32*b* and 34 of the notch 21 in this embodiment are formed as plane surfaces for simplicity of manufacture but may be formed with other configurations, if desired, while retaining advantages of the invention. For example, the top of the notch 21 at pole planting region 29 can be formed with a circular or oval configuration among other examples provided that it remains substantially broader than the more forward portion of the notch 21. Similarly, the strictly upright orientation of the sidewalls 32*a* and 32*b* of the forward portion 28 of the notch 21 in this embodiment and the exact conformity of the base of the notch with the vaulting box recess 31 serve to maximize the extent of cushioning but some variation in these parameters can be tolerated.

OPERATION

In use, the component units 24*a*, 24*b*, 24*c*, 26*a* and 26*b* and cover 27 of the cushion 19 are secured together at the vaulting installation by engaging straps 22, buckles 23 and cover fasteners 25, the landing cushion 19 being assembled in position to locate the notch 21 over the vaulting box 12. Vaulting may then proceed in the normal manner except insofar as the cushion construction allows the athletes to be much less concerned about pole contact and about the problems of landing at the conclusion of the vaults.

As problems from pole contact are effectively avoided, the configuration of the notch 21 does not create an inducement to position the landing cushion an undesirable distance back from the vaulting box 12 which practice has previously been a very common one by athletes intent on maximizing performance at the expense of protection if necessary. The invention in its preferred forms not only eliminates the motivation for such mispositioning of the landing cushion but also effectively discourages intentional or inadvertent misplacement of that kind. If the landing cushion 19 should be displaced a significant distance backwardly from the vaulting box 12 relative to the proper placement as depicted in FIG. 2 for example, then interference from pole contact with the sidewalls of the relatively narrow forward portion 28 of the notch 21 is virtually assured. The broad top area of the pole planting region 29 can accommodate the maximum amount of pole bending which occurs during a vault. The relatively narrow forward region 28 cannot. Thus the novel configuration of the notch 21 is essentially one which dictates correct placement of the landing cushion 19.

While the invention has been described with respect to a specific preferred example, many variations are possible and is not intended to limit the invention except as defined in the following claims.

I claim:

1. In a pole vaulter's landing cushion having a front end with a rearwardly extending notch therein for receiving the base of a vaulting pole, the notch having spaced apart sidewalls defining a pole planting region at the back end of the notch and defining a more forward region between the pole planting region and the front end of the cushion, the improvement comprising:

a notch configuration wherein the top of said notch is sufficiently broad at said pole planting region to accommodate a predetermined amount of bending of said pole towards the sides of said notch while being sufficiently narrower at said forward region to inhibit said predetermined amount of bending of said pole towards said sides of said notch, said sidewalls being stepped at the location where said pole planting region connects with said forward region to provide an abrupt change in the width of the top of said notch at said location.

2. A pole vaulter's landing cushion as set forth in claim 1 in which said notch at said pole planting region is narrower at the base thereof than at the top thereof, said notch sidewalls at said pole planting region being slanted upwardly and outwardly from said base of said pole planting region to said top thereof, said notch sidewalls having a more vertical orientation at said forward region of said notch.

3. A pole vaulter's landing cushion as set forth in claim 1 wherein said cushion is of substantially uniform height from said front end thereof back to said pole planting region of said notch, said uniform height being less than the height of the portion of said cushion which is behind said pole planting region.

4. A pole vaulter's landing cushion as set forth in claim 1 for disposition at a vaulting box having a pole planting recess of predetermined outline and area wherein the base of said notch substantially conforms in outline and area with said outline and area of said recess of said vaulting box.

5. A pole vaulter's landing cushion as set forth in claim 1 wherein the top of said notch has a substantially T-shaped outline.

6. A pole vaulter's landing cushion as set forth in claim 1 wherein the base of said notch is narrower at said pole planting region than at said forward region and wherein the portions of said notch sidewalls which define said forward region are divergent towards said front of said cushion.

7. A pole vaulter's landing cushion as set forth in claim 1 wherein the portions of said sidewalls of said notch which define said forward portion thereof are at least substantially vertical.

8. A pole vaulter's landing cushion comprising a volume of resilient material having an end surface and a notch which extends inwardly from said end surface to a pole planting region, the top of said notch being of greater width at said pole planting region than at said end surface, wherein the width of the top of said notch changes non-uniformly between said end surface and said pole planting region, in which said pole planting region of said notch is spaced inwardly from said end surface and has a width sufficient to accommodate a predetermined amount of bending of a vaulting pole towards the sides of said notch, and in which a second region of said notch that is closer to said end surface has a smaller width which is insufficient to accommodate to said predetermined amount of bending of a vaulting pole towards said sides of said notch.

9. A pole vaulter's landing cushion as defined in claim 8 wherein the walls of said volume of said resilient material that define said first region of said notch at the sides and the back thereof are inclined and are convergent in the downward direction.

10. A pole vaulter's landing cushion as defined in claim 9 wherein the walls of said volume of resilient material that define said second portion of said notch are substantially vertical.

11. A pole vaulter's landing cushion comprising a volume of resilient material having an end surface and a notch which extends inwardly from said end surface, in which a first region of said notch that is spaced inwardly from said end surface has a width sufficient to accommodate a predetermined amount of bending of a vaulting pole towards the sides of said notch, and in which a second region of said notch that is closer to said end surface has a smaller width which is insufficient to accommodate to said predetermined amount of bending of a vaulting pole towards said sides of said notch, wherein the bottom of said notch is of progressively increasing width towards said end surface of said volume of resilient material and wherein the width of the top of said notch increases non-uniformly, said width of the top of said notch being abruptly increased at the boundary between said first and second regions thereof.

12. A pole vaulter's landing cushion comprising a volume of resilient material having a front surface with a pole receiving notch therein, said notch having spaced apart opposite sidewalls and a rear wall extending therebetween, the bases of said sidewalls being divergent from said rearwall towards said front surface of said cushion, the tops of said sidewalls being most widely spaced apart at a pole planting region of said notch which is adjacent said rear wall and being directed substantially transversely on said cushion at a location intermediate between said rear wall and said front surface of said cushion to define a forward portion of said notch which is substantially narrower than the top of said pole planting region of said notch.

* * * * *